US006302335B1

(12) United States Patent
Ormiston et al.

(10) Patent No.: US 6,302,335 B1
(45) Date of Patent: Oct. 16, 2001

(54) LAWN SPRINKLER SYSTEM

(75) Inventors: Timothy G. Ormiston, 1717 Sycamore St., Twin Lakes, WI (US) 53181; Sharyn A. Ormiston, Twin Lakes, WI (US)

(73) Assignee: Timothy G. Ormiston, Twin Lakes, WI (US)

( * ) Notice: Subject to any disclaimer, the term of this patent is extended or adjusted under 35 U.S.C. 154(b) by 0 days.

(21) Appl. No.: 09/668,248

(22) Filed: Sep. 22, 2000

(51) Int. Cl.[7] ..... A62C 31/22; B05B 15/06

(52) U.S. Cl. ..... 239/276; 239/214; 239/225.1; 239/251; 239/256; 239/262; 239/271; 239/279; 239/280; 239/285; 239/380; 239/381

(58) Field of Search ..... 239/214, 222, 239/225.1, 251, 255, 256, 262, 266, 268, 271, 273, 276, 279, 280, 285, 380, 381, 569

(56) References Cited

U.S. PATENT DOCUMENTS 1,180,526 * 4/1916 Partridge ..... 239/251 X
1,564,934 * 12/1925 Buelna et al. ..... 239/262 X
1,791,222 * 2/1931 Orr ..... 239/262 X
2,176,243 * 10/1939 Braungart .
2,323,701 * 7/1943 Barksdale ..... 239/276 X
2,335,332 * 11/1943 Wright ..... 239/262 X
2,336,725 * 12/1943 Engelhart ..... 239/262
3,326,551 * 6/1967 Clarke ..... 239/251 X
3,586,239 * 6/1971 Blass ..... 239/276
3,929,288 * 12/1975 Brusadin et al. ..... 239/276 X

* cited by examiner

*Primary Examiner*—David A. Scherbel
*Assistant Examiner*—Robin O. Evans
(74) *Attorney, Agent, or Firm*—Jansson, Shupe & Munger, Ltd.

(57) ABSTRACT

A lawn sprinkler system is provided for receiving fluid from a fluid source and distributing the fluid over an area. The lawn sprinkler system includes multiple lawn sprinklers for distributing fluid over corresponding portions of the area. Stake assemblies are provided for supporting the lawn sprinklers above a supporting surface. Each stake assembly includes an input operatively connected to the fluid source, a first output for providing fluid to the corresponding sprinkler, and a second output. A conduit interconnects the second output of one of the stake assemblies to the input of an adjacent stake assembly to connect the adjacent stake assembly to the fluid source.

20 Claims, 4 Drawing Sheets

LAWN SPRINKLER SYSTEM

FIELD OF THE INVENTION

This invention relates to lawn sprinklers, in particular, to a lawn sprinkler system which utilizes multiple lawn sprinklers and which allows for the flow of water distributed through each lawn sprinkler to be regulated.

BACKGROUND AND SUMMARY OF THE INVENTION

As is known, lawn sprinklers are used to irrigate lawns, gardens and the like. Typically, lawn sprinklers are interconnected to a fluid source through a tube or garden hose. Fluid flows from the fluid source, through the lawn sprinkler, and exits the lawn sprinkler through a plurality of nozzles or openings therein such that the fluid is distributed over an enlarged area to be irrigated. In order to prevent the collection of fluid at a particular locale, it is highly desirable for the lawn sprinkler to evenly distribute the fluid over the entire area to be irrigated.

Heretofore, prior art lawn sprinklers incorporated fluid disbursement elements having a plurality of nozzles therein. In order to effectuate the even distribution of fluid over the area to be irrigated, the fluid disbursement elements either rotate or oscillate during application of the fluid in response to the pressure of the fluid flowing therethrough. In certain applications, use of a single lawn sprinkler may be inadequate to irrigate the entire area sought. Therefore, it may be necessary to provide multiple lawn sprinklers for use in irrigating an enlarged area. However, prior art lawn sprinklers contemplate direct connection to corresponding fluid sources. Consequently, it is highly desirable to provide a lawn sprinkler system which allows for multiple lawn sprinklers to be utilized in connection with a single fluid source.

Further, if multiple lawn sprinklers are used to irrigate an enlarged area, the lawn sprinklers must be arranged such that fluid is distributed over the entire area to be irrigated. However, if certain areas of the enlarged area needed greater irrigation, the arrangement of the lawn sprinklers must be modified. Consequently, it is also highly desirable to provide a lawn sprinkler which allows the area upon which the fluid is distributed to be adjusted.

Therefore, it is a primary object and feature of the present invention to provide a lawn sprinkler system which incorporates multiple lawn sprinklers which utilize a common fluid source.

It is a further object and feature of the present invention to provide a lawn sprinkler system which allows for the area over which the fluid is distributed thereby to be adjusted.

It is a still further object and feature of the present invention to provide a lawn sprinkler system which is simple to assemble and inexpensive to manufacture.

In accordance with the present invention, a lawn sprinkler is provided for receiving fluid from a fluid source and distributing fluid over an area. The lawn sprinkler includes a tubular support pole extending along a longitudinal axis and having first and second ends. The support pole includes an inner surface defining a flow path therethrough. A fluid distribution member has an interior for receiving the fluid to be distributed and an opening therein for allowing the fluid to exit the lawn sprinkler therethrough. A tubular housing defines a passageway therethrough. The housing has a first end for receiving the first end of the support pole and a second opposite end. The bushing assembly is connectable to the distribution member and partially received in the second end of the housing. The bushing assembly includes an outer bushing having an inner surface and an outer surface engaging the inner surface of the housing. The bushing assembly further includes an inner bushing having a first end operatively connected to the fluid distribution member and a second opposite end. The inner bushing has an outer surface which forms the rotational interface with the inner surface of the outer bushing and an inner surface defining a flow passage communicating with the flow path through the support pole.

The lawn sprinkler may also include a stake assembly interconnected to the second end of the support pole. The stake assembly has a stake extending therefrom for insertion into a supporting surface. The stake assembly includes an input operatively connected to the fluid source and an output communicating with the flow path through the support pole. The stake assembly may also include a second output and a plug removably connected to the stake assembly for closing the second output thereof.

An adaptor interconnects the stake assembly and the second end of the support pole. The adaptor has an input communicating with the output of the stake assembly and an output communicating with the flow path through the support pole. A flow restrictor is seated in the output of the adaptor for limiting the flow of fluid into the flow path of the support pole.

The bushing assembly may include a connection element for interconnecting the inner bushing to the fluid distribution member. The connection element includes an input communicating with the flow passage in the inner bushing, an output communicating with the interior of the fluid distribution member and a flow passage therebetween. A speed control element is interconnected to the connection element. The speed control element is movable between the first position and a second position wherein the speed control element extends into the flow passage of the connection element so as to limit the flow of fluid therepast. A connector may be threaded onto the second end of the inner bushing for maintaining the outer bushing on the inner bushing.

In accordance with a still further aspect of the present invention, a lawn sprinkler is provided for receiving fluid from a fluid source and distributing fluid over an area. The lawn sprinkler includes a tubular support pole extending along a longitudinal axis and having first and second ends. The support pole includes an inner surface defining a flow path therethrough. The fluid distribution member has an interior for receiving the fluid to be distributed and an opening therein for allowing the fluid to exit the lawn sprinkler therethrough. A tubular housing defines a passageway therethrough. The housing has a first end for receiving the first end of the support pole and a second opposite end. A bushing assembly connects the interior of the fluid distribution member and the flow path through the support pole. A speed control element is disposed between the flow path through the support pole and the interior of the fluid distribution member. The speed control element is movable between a first position and a second position wherein the speed control limits the flow of fluid therepast.

The bushing assembly includes an outer bushing having an inner surface and an outer surface engaging the inner surface of the housing. In addition, the bushing assembly includes an inner bushing having a first end operatively connected to the fluid distribution member and a second opposite end. The inner bushing has an outer surface which forms a rotational interface of the outer bushing and an inner surface which defines a flow passage communicating with the flow path through the support pole.

It is contemplated that a stake assembly support the support pole above a supporting surface. The stake assembly includes an input operatively connected to the fluid source and an output communicating with the flow path through the support pole. The stake assembly further includes a second output and a plug operatively connected to a stake assembly for closing the second output thereof.

An adaptor interconnects the stake assembly and the second end of the support pole. The adaptor has an input communicating with the output of the stake assembly and an output communicating with the flow path through the support pole. A flow restrictor is seated in the output of the adaptor for limiting the flow of fluid into the flow path through the support pole.

In accordance with a still further aspect of the present invention, a lawn sprinkler system is provided for receiving fluid from a fluid source and distributing the fluid over an area. The lawn sprinkler system includes a first sprinkler for distributing over a first portion of the area and a second sprinkler for distributing over a second portion of the area A first stake assembly supports the first sprinkler above a supporting surface. The first stake assembly includes an input operatively connected to the fluid source, a first output for providing fluid to the first sprinkler and a second output. A second stake assembly supports the second sprinkler above the supporting surface. The second stake assembly includes an input and an output for providing fluid to the second sprinkler. A conduit interconnects the second output of the first stake assembly and the input of the second stake assembly.

Each sprinkler includes a tubular support pole which extends along the longitudinal axis and has first and second ends. The support pole includes an inner surface defining a flow path therethrough. A fluid distribution member has an interior for receiving the fluid to be distributed and an opening therein for allowing the fluid to exit a corresponding sprinkler therethrough. A tubular housing defines a passageway therethrough. The housing has a first end for receiving the first end of the support pole and a second opposite end. A bushing assembly connects the interior of the fluid distribution member and the flow path through the support pole. A speed control element is disposed between the flow path through the support pole and the interior of the fluid distribution member. The speed control element is moved between the first position and a second position wherein the speed control element limits the flow of fluid therepast.

Each bushing assembly includes an outer bushing and an inner bushing. The outer bushing has an inner surface and an outer surface engaging the inner surface of the housing. The inner bushing has a first end operatively connected to the fluid distribution member and a second opposite end. The inner bushing has an outer surface which forms a rotational interface with the inner surface of the outer bushing and an inner surface defining a flow passage communicating with the flow path through the support pole. Each stake assembly may include flow restrictor for limiting the fluid provided to a corresponding sprinkler.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

BRIEF DESCRIPTION OF THE PREFERRED EMBODIMENT

Figure 4:
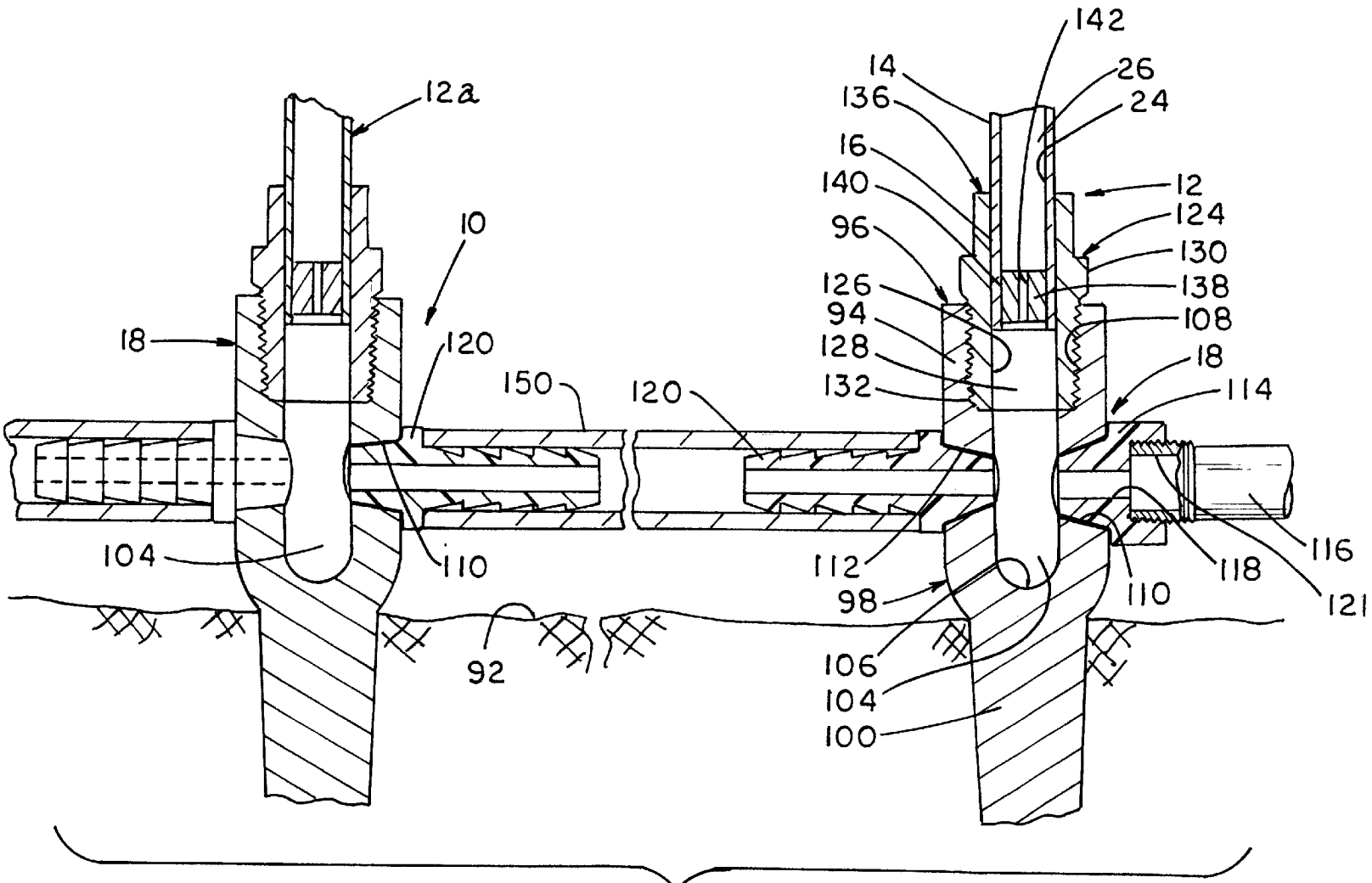
FIG. 4 is an enlarged sectional view showing a portion of the lawn sprinkler system of the present invention.

Referring to FIG. 4, a lawn sprinkler system in accordance with the present invention is generally designated by the reference numeral 10. Lawn sprinkler system 10 utilizes a plurality of lawn sprinklers 12 which are identical in structure. As such, the description hereinafter of lawn sprinkler 12 is understood to describe each lawn sprinkler in lawn sprinkler system 10 as if fully described hereinafter.

Figure 1:
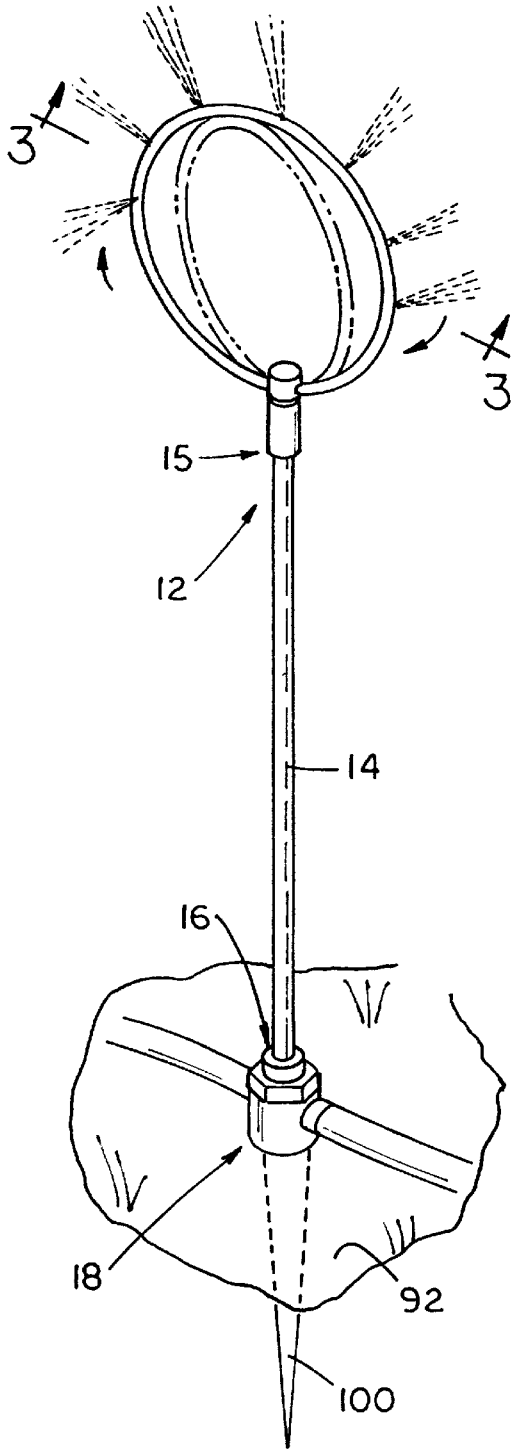
FIG. 1 is an isometric view of a lawn sprinkler for use in a lawn sprinkler system in accordance with the present invention.
Figures 3, 3A:
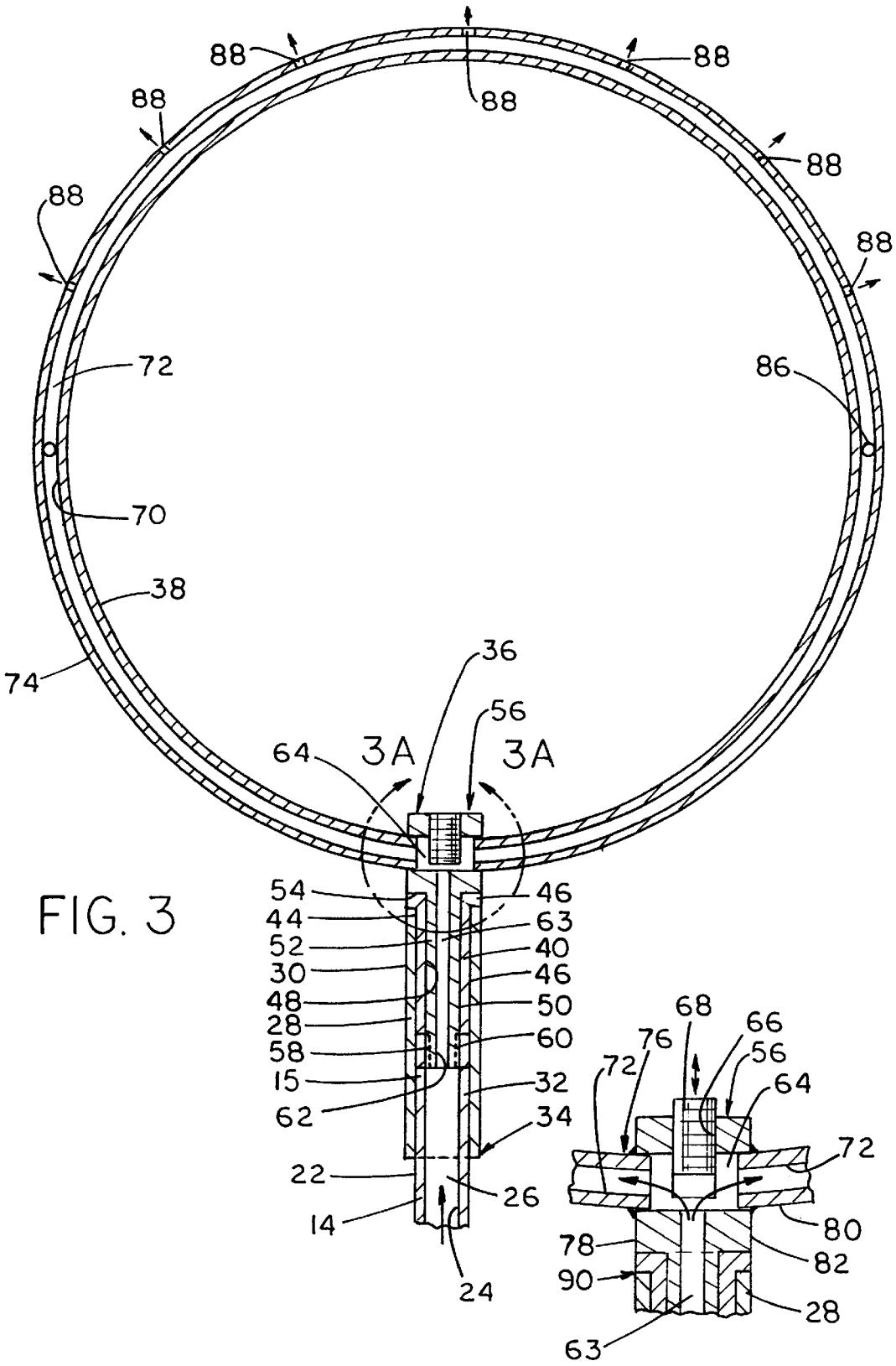
FIG. 3 is a sectional view showing a portion of the lawn sprinkler of FIG. 2.
FIG. 3*a* is an enlarged sectional view taken along line 3*a*—*a* of FIG. 3.

Lawn sprinkler 12 includes a generally hollow support pole 14 extending along a longitudinal axis. Support pole 14 includes a first upper end 15 and a second lower end 16 interconnected to a stake assembly 18 in a manner hereinafter described, FIG. 1. As best seen in FIG. 3, support pole 14 includes a generally cylindrical outer surface 22 and a generally cylindrical inner surface 24 which defines a flow path 26 through support pole 14. Tubular housing 28 is mounted on upper end 15 of support pole 14. Tubular housing 28 includes a generally cylindrical outer surface 30 and a generally cylindrical inner surface 32. Upper end 15 of support pole 14 is inserted within lower end 34 of housing 28 and interconnected thereto in any suitable manner such as by welding or the like.

Referring to FIGS. 3 and 3*a*, a bushing assembly, generally designated by the reference numeral 36, is provided for supporting fluid distribution member 38. Bushing assembly 36 includes an outer bushing 40 having a radially extending flange 42 projecting from a first end 44 thereof. Outer bushing 40 includes an outer surface 46 and an inner surface 48. Outer bushing 40 is positioned on the outer surface 50 of inner bushing 52. Inner bushing 52 includes a first end 54 having an enlarged head 56 formed thereon and a second opposite end 58. Threads are formed along the outer surface 50 of inner bushing 52 adjacent second end 58 thereof for receiving a nut 60 thereon. Inner bushing 52 further includes an inner surface 62 which defines a flow passage 63. Flow passage 63 communicates with passageway 64 through head 56 thereof.

Head 56 of inner bushing 52 includes an aperture 66 therein which communicates with passageway 64 therethrough. A flow regulator 68 is threaded into aperture 66 and movable between a first non-interfering relationship wherein flow regulator 68 is removed from passageway 64 through head 56 of inner bushing 52 and an interfering position wherein flow regulator 68 extends into passageway 64 through head 56 of inner bushing 52.

Flow distribution member 38 is generally tubular and includes an inner surface 70 defining the interior 72 thereof and an outer surface 74. First end 76 of fluid distribution member 38 is rigidly connected to a first side 78 of head 56 of inner bushing 52 such that interior 72 of fluid distribution member 38 communicates with passageway 64 through head 56 of inner bushing 52. Similarly, second end 80 of fluid distribution member 38 is rigidly connected to a second side 82 of head 56 of inner bushing 52 such that interior 72 of fluid distribution member 38 communicates with passageway 64 through head 56 of inner bushing 52.

Figure 2:
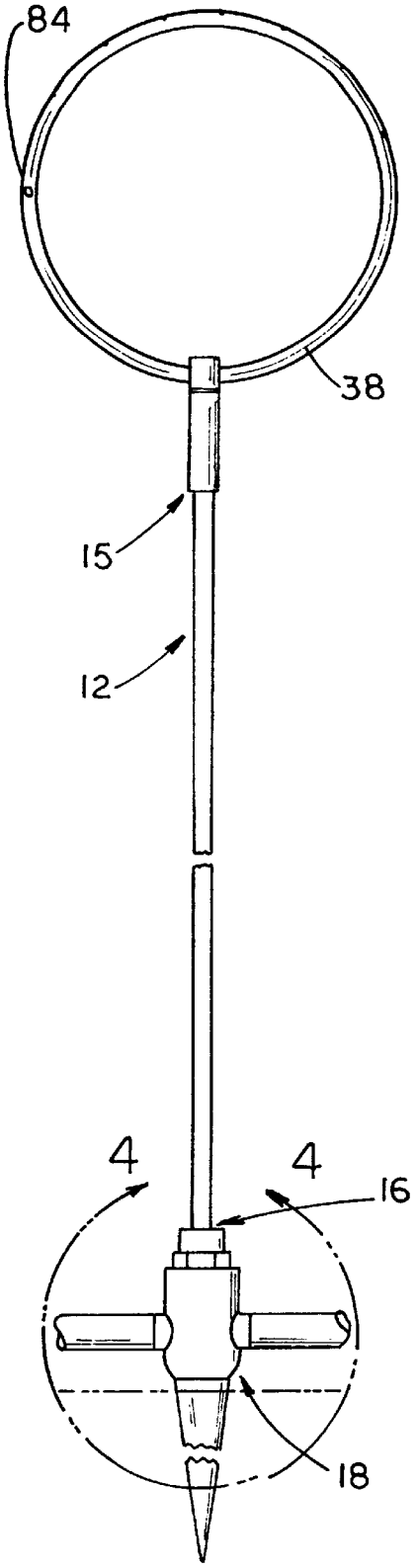
FIG. 2 is a front elevational view of the lawn sprinkler of FIG. 1.

Fluid distribution member 38 includes an opening 84, FIG. 2, and a first side thereof and a second opening 86 in a second side thereof. Openings 84 and 86 in fluid distribution member 38 allow for fluid in the interior 72 thereof to be disbursed therefrom. In addition, openings 84 and 86 in fluid distribution member 38 facilitate rotation of fluid distribution ring 38 about the longitudinal axis of support pole 14 as hereinafter described. Fluid distribution member 38 may also include an additional set of openings 88 along the upper portion thereof to further allow fluid in the interior of fluid distribution member 38 to be disbursed therefrom.

In order to mount fluid distribution member 38 on support pole 14, inner bushing 52 is inserted through outer bushing 40 such that head 56 of inner bushing 52 engages flange 42 of outer bushing 40 and such that outer surface 50 of inner bushing 52 forms a rotational interface with the inner surface 48 of outer bushing 40. Nut 60 is threaded onto the threads along second end 58 of inner bushing 52 so as to capture outer bushing 40 thereon. Outer bushing 40 is press fit into upper end 90 of tubular housing 28 such that flange 42 engages upper end 90 of tubular housing 28 and such that flow passage 63 through inner bushing 52 communicates with flow path 26 through support pole 14. It can be appreciated that inner bushing 52, and hence fluid distribution member 38, may rotate about the longitudinal access of support pole 14.

Referring to FIG. 4, stake assembly 18 is provided for supporting support pole 14 and fluid distribution member 38 above a supporting surface 92. Stake assembly 18 includes a generally cup-shaped body portion 94 having a first upper end 96 and a second lower end 98. A spike 100 depends from lower end 98 of body portion 94. Spike 100 is generally pyramidal in shape and is provided for insertion into supporting surface 92 in a conventional manner.

Figure 5:
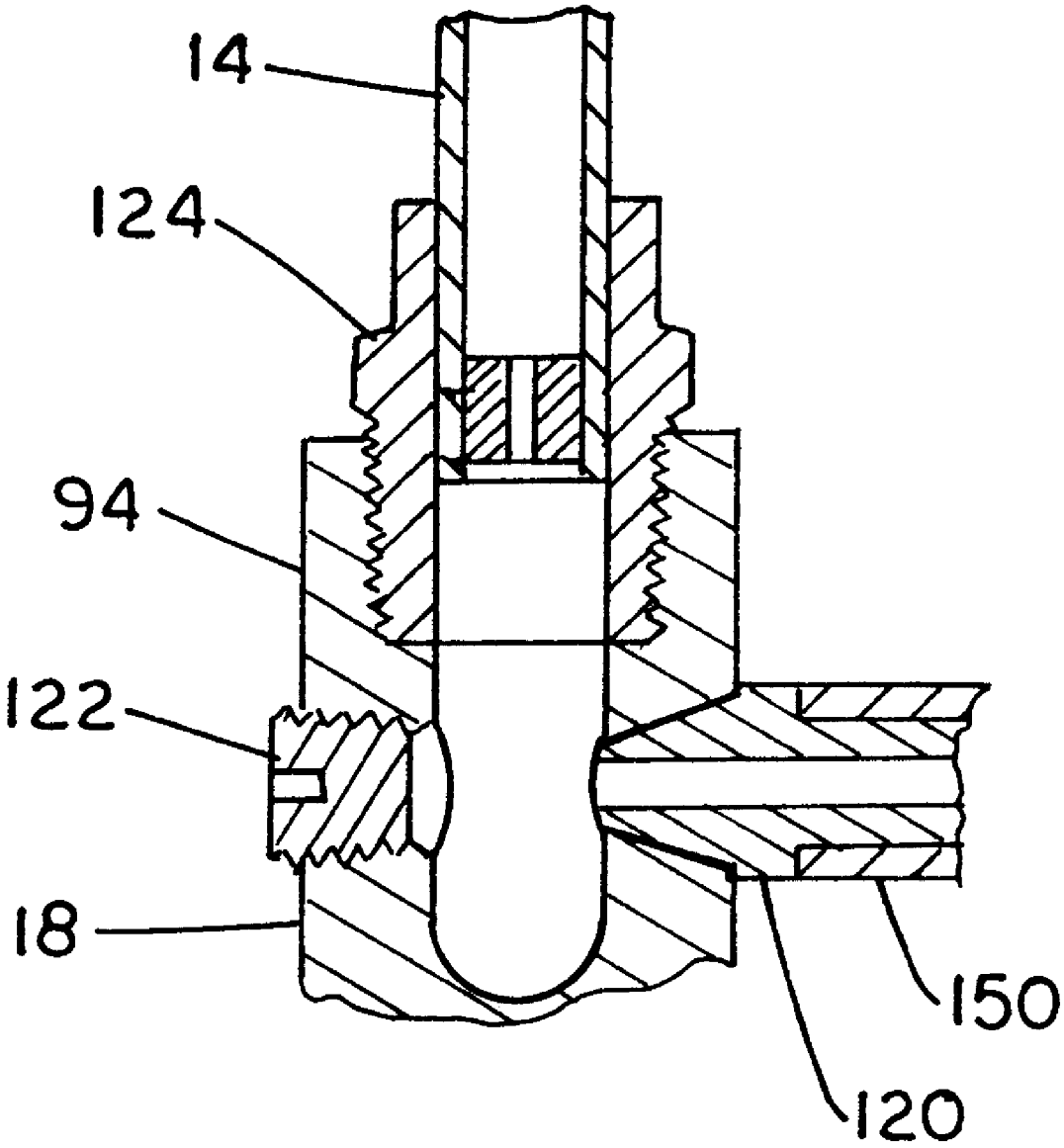
FIG. 5 is an enlarged sectional view showing a portion of the lawn sprinkler system of the present invention.

Body portion 94 includes a cavity 104 extending into the upper end 96 thereof. Cavity 104 in body portion 94 of stake assembly 18 is defined by a generally cup-shaped inner surface 106. Upper portion 108 of inner surface 106 includes a plurality of threads thereon which define a first output in stake assembly 18. Stake assembly 18 further includes an input 110 and a second output 112 which communicate with cavity 104. Input 110 in stake assembly 18 is adapted for receiving a coupling 114 for coupling a garden hose 116 to stake assembly 18. Coupling 114 includes a passageway 118 therethrough which communicates with the interior 121 of garden hose 116 and with cavity 104 in stake assembly 18. It is intended that garden hose 116 be interconnected to a fluid source such as a water spigot or the like. Second output 112 in stake assembly 118 is adapted for receiving a barbed fitting 120 or a plug 122, FIG. 5, for reasons hereinafter described.

In order to interconnect lower end 16 of support pole 14 to stake assembly 18, adaptor 124 is provided. Adaptor 124 includes an inner surface 126 which defines a fluid passageway 128 therethrough and an outer surface 130. Threads 132 are provided along outer surface 130 adjacent lower end 132 of adaptor 124 in order to mesh with the threads along upper portion 108 of inner surface 106 of stake assembly 18 such that flow passageway 128 communicates with cavity 104 in stake assembly 18.

Lower end 16 of support pole 14 is inserted into and rigidly connected to upper end 136 of adaptor 124 such that flow path 26 through support pole 14 communicates with cavity 104 in adaptor 124 through flow passageway 128 in adaptor 124. It is contemplated to provide a flow restrictor 138 within flow path 26 in support pole 14 adjacent lower end 16 thereof. Flow restrictor 138 includes an outer surface 140 which forms a sealing interface with the inner surface 24 of support pole 14 and an inner surface 142 which defines a restricted passageway through flow restrictor 138. Restricted passageway through flow restrictor 138 has a diameter less than the diameter of passageway 128 in adaptor 124 so as to limit the volume of fluid which flows into flow path 26 through support pole 14.

In operation, garden hose 116 has a first end interconnected to a fluid source and a second end interconnected to input 110 of stake assembly 18. If it is intended that a single lawn sprinkler 12 is to be used, plug 122 is threaded into second output 112 of stake assembly 18, FIG. 5. In such arrangement, fluid flows through the garden hose 116 and into cavity 104 in stake assembly 118. Due to the pressure of the fluid received from the fluid source, the fluid is urged upwardly through the restricted passageway in flow restrictor 138 into flow path 26 of support pole 14. The fluid continues to flow upwardly through flow path 26 in support pole 14 and through flow passage 63 in inner bushing 52. The fluid continues through passageway 64 through head 56 of inner bushing 52 into the interior 72 of fluid distribution member 38. Fluid fills interior 72 of fluid distribution member 38 and, thereafter, exits interior 72 of fluid distribution member 38 through openings 84, 86, and 88 therein.

Due to the fluid pressure associated with the exiting of the fluid from the fluid distribution member 38, the fluid exiting openings 84 and 86 urge fluid distribution member 38 clockwise. As the fluid exiting fluid distribution member 38 urges fluid distribution member 38 clockwise, the outer surface 50 of inner bushing 52 forms a rotational interface with the inner surface 48 of outer bushing 40 thereby allowing fluid distribution member 38 to rotate about the longitudinal axis of support pole 14.

If multiple lawn sprinklers 12 and 12*a*, FIG. 4, are used in lawn sprinkler systems, plug 122 in second output 112 of stake assembly 18 is replaced with barbed fitting 120. In addition, coupling 114 in input 110 of stake assembly 18 of an adjacent lawn sprinkler 12*a* is replaced with a barbed fitting 120. Conduit 150 interconnects barbed fitting 120 attached to second output 112 of stake assembly 18 of lawn sprinkler 12 to barbed fitting 120 attached to input 110 in stake assembly 18 of adjacent lawn sprinkler 12*a* such that cavity 104 in stake assembly 18 of lawn sprinkler 12*a* is in fluid communication with cavity 104 in stake assembly 18 of lawn sprinkler 12.

As described, a portion of the fluid from the fluid source is distributed through lawn sprinkler 12 as heretofore described and a portion of the fluid from the fluid source is distributed through lawn sprinkler 12*a*. It can be appreciated that lawn sprinkler 10 may include a plurality of lawn sprinklers being serially connected as heretofore described. It can be further appreciated that plug 122 must be threaded into the second output 112 in stake assembly 18 of the last lawn sprinkler 12 in the serial chain so as to maintain the fluid pressure in lawn sprinkler system 10.

Various modes of carrying out the invention are contemplated as being within the scope of the following claims particularly pointing out and distinctly claiming the subject matter which is regarded as the invention.

What is claimed is:

1. A lawn sprinkler for receiving fluid from a fluid source and distributing the fluid over an area, comprising:

a tubular support pole extending along a longitudinal axis and having distal and proximal ends, the support pole including an inner surface defining a flow path therethrough;

a fluid distribution member having an interior for receiving the fluid to be distributed and an opening therein for allowing fluid to exit the lawn sprinkler therethrough;

a tubular housing defining a passageway therethrough, the housing having an inner surface and having a first end for receiving the first end of the support pole and a second opposite end; and a bushing assembly interconnected to the fluid distribution member and partially received in the second end of the housing, the bushing assembly including:

an outer bushing having an inner surface and an outer surface engaging the inner surface of the housing;

an inner bushing having a first end operatively connected by a connection element to the fluid distribution member and a second, opposite end, the inner bushing having outer surface forming a rotational interface with the inner surface of the outer bushing and an inner surface defining a flow passage communicating with the flow path through the support pole; and a speed control element interconnected to said connection element, threaded into said inner bushing and axially movable between a first non-interfering relationship in which said speed control element is removed from said flow passage and a second interfering position in which said speed control element extends axially into said flow passage.

2. The lawn sprinkler of claim 1 further comprising a stake assembly interconnected to the proximal end of the support pole, the stake assembly including a stake extending therefrom for insertion into a supporting surface.

3. The lawn sprinkler of claim 2 wherein the stake assembly includes an input operatively connected to the fluid source and an output communicating with the flow path through the support pole.

4. The lawn sprinkler of claim 3 wherein the stake assembly includes a second output.

5. The lawn sprinkler of claim 4 further comprising a plug removably connected to the stake assembly for closing the second output thereof.

6. The lawn sprinkler of claim 3 further comprising an adaptor for interconnecting the stake assembly and the proximal end of the support pole, the adaptor having an input communicating with the output of the stake assembly and an output communicating with the flow path through the support pole.

7. The lawn sprinkler of claim 6 further comprising a flow restrictor seated in the output of the adaptor for limiting the flow of fluid into the flow path in support pole.

8. The lawn sprinkler of claim 1 wherein the connection element includes an input communicating with the flow passage in the inner bushing, an output communicating with the interior of the fluid distribution member and a flow passage therebetween.

9. The lawn sprinkler of claim 1 further comprising a stake assembly for supporting the support pole above a supporting surface, the stake assembly including an input operatively connected to the fluid source and an output communicating with the flow path through the support pole.

10. The lawn sprinkler of claim 1 further comprising a connector threaded onto the second end of the inner bushing for maintaining the outer bushing on the inner bushing.

11. The lawn sprinkler of claim 9 wherein the stake assembly further includes a second output and a plug removably connected to the stake assembly for closing the second output thereof.

12. The lawn sprinkler of claim 9 further comprising an adaptor for interconnecting the stake assembly and the proximal end of the support pole, the adaptor having an input communicating with the output of the stake assembly and an output communicating with the flow path through the support pole.

13. The lawn sprinkler of claim 12 further comprising a flow restrictor seated in the output of the adaptor for limiting the flow of fluid into the flow path in support pole.

14. A lawn sprinkler assembly for receiving fluid from a fluid source and distributing the fluid over an area, comprising:

a tubular supply line forming a flow path therethrough and having distal and proximal portions;

a fluid distribution member having an interior for receiving the fluid to be distributed and at least one outlet therein allowing fluid to exit;

a tubular housing having a first end affixed to the distal portion of the supply line and a second opposite end, said housing defining a longitudinal axis;

a bushing assembly engaged with the tubular housing the bushing assembly having a passageway connecting the supply line flow path to the interior of the fluid distribution member; and a speed control element disposed between the flow path and the interior of the fluid distribution member, the speed control element movable along the axis between a first position in which the speed control element is located outside of the passageway and a second axially displaced position in which the speed control element limits the flow of fluid therepast.

15. The lawn sprinkler of claim 14 wherein the bushing assembly includes:

an outer bushing having an inner surface and an outer surface engaging the housing; and an inner bushing having a first end operatively connected to the fluid distribution member and a second, opposite end, the inner bushing having an outer surface forming a rotational interface with the inner surface of the outer bushing and an inner surface defining a flow passage communicating with the flow path through the supply line.

16. A lawn sprinkler system for receiving fluid from a fluid source, transporting the fluid through a passageway and distributing the fluid over an area, comprising:

a first sprinkler for distributing fluid over a first portion of the area;

a second sprinkler for distributing fluid over a second portion of the area;

a first stake assembly for supporting the first sprinkler above a supporting surface, the first stake assembly including an input operatively connected to the fluid source, a first output for providing fluid to the first sprinkler and a second output;

a second stake assembly for supporting the second sprinkler above the supporting surface, the second stake assembly including an input and an output for providing fluid to the second sprinkler;

a conduit for interconnecting the second output of the first stake assembly and the input of the second stake assembly;

a first speed control element for controlling a flow rate of fluid through said first sprinkler said first speed control element axially movable within said first sprinkler between a first non-interfering relationship in which said first speed control element is located outside the passageway and a second interfering position in which said first speed control element extends axially into the passageway; and a second speed control element for controlling a flow rate of fluid through said second sprinkler, said second speed control element axially movable within said second sprinkler between a first non-interfering relationship in which said second speed control element is located outside the passageway and a second interfering position in which said second speed control element extends axially into the passageway.

17. The lawn sprinkler system of claim 16 wherein each stake assembly includes a flow restrictor for limiting the fluid provided to a corresponding sprinkler.

18. The lawn sprinkler system of claim 16 wherein each sprinkler includes:

a tubular support pole extending along a longitudinal axis and having distal and proximal ends, the support pole including an inner surface defining a flow path therethrough;

a fluid distribution member having an interior for receiving the fluid to be distributed and an opening therein for allowing fluid to exit the lawn sprinkler therethrough;

a tubular housing defining the passageway therethrough, the housing having an inner surface and having a first end for receiving the distal end of the support pole and a second opposite end; and a bushing assembly for connecting the interior of the fluid distribution member and the flow path through the support pole.

19. The lawn sprinkler system of claim 18 wherein each bushing assembly includes:

an outer bushing having an inner surface and an outer surface engaging the inner surface of the housing; and an inner bushing having a first end operatively connected to the fluid distribution member and a second, opposite end, the inner bushing having outer surface forming a rotational interface with the inner surface of the outer bushing and an inner surface defining a flow passage communicating with a flow path through the support pole.

20. The lawn sprinkler system of claim 19 each speed control element is threaded into corresponding said inner bushing.

* * * * *